US007849938B1

(12) United States Patent
Maier

(10) Patent No.: US 7,849,938 B1
(45) Date of Patent: Dec. 14, 2010

(54) GROUND AUGERING ASSEMBLY

(76) Inventor: Jerry A. Maier, 9892 SW. Hodges Rd., Augusta, KS (US) 67010

( * ) Notice: Subject to any disclaimer, the term of this patent is extended or adjusted under 35 U.S.C. 154(b) by 141 days.

(21) Appl. No.: 12/388,957

(22) Filed: Feb. 19, 2009

(51) Int. Cl.
*E21B 10/44* (2006.01)

(52) U.S. Cl. ..... 175/209; 175/323; 175/394

(58) Field of Classification Search ..... 175/84, 175/88, 207, 211, 323, 324, 394, 209; 111/116; 172/25, 11, 532
See application file for complete search history.

(56) References Cited

U.S. PATENT DOCUMENTS

| | | | | |
|---|---|---|---|---|
| 2,061,218 | A | 11/1936 | Watson | |
| 2,321,680 | A | 6/1943 | Houston | |
| 2,490,471 | A * | 12/1949 | Ragoss | 173/146 |
| 2,614,805 | A * | 10/1952 | Swan | 173/26 |
| 2,709,572 | A | 5/1955 | Ageborn | |
| 2,783,974 | A | 3/1957 | Veasman | |
| 2,887,300 | A | 5/1959 | Meredith | |
| 3,043,382 | A * | 7/1962 | Meredith | 175/84 |
| 3,190,375 | A | 6/1965 | Pearson | |
| 3,422,913 | A | 1/1969 | Young, Jr. | |
| 4,148,366 | A | 4/1979 | Beckstrom et al. | |
| 4,228,862 | A | 10/1980 | Causse | |
| 4,364,441 | A | 12/1982 | Geeting | |
| 4,550,787 | A | 11/1985 | Stefan | |
| 4,553,612 | A | 11/1985 | Durham | |
| 4,750,571 | A | 6/1988 | Geeting | |
| 4,807,710 | A * | 2/1989 | Greeley | 175/394 |
| 5,067,570 | A | 11/1991 | Gilcrease | |
| 5,251,707 | A | 10/1993 | Grahl | |
| 5,645,376 | A | 7/1997 | Taki | |
| 5,655,610 | A | 8/1997 | Skinner | |
| 6,296,068 | B1 * | 10/2001 | Frederick | 175/323 |
| 6,749,032 | B2 | 6/2004 | Snyder, Sr. | |

* cited by examiner

*Primary Examiner*—William P Neuder
*Assistant Examiner*—Blake Michener
(74) *Attorney, Agent, or Firm*—Kenneth H. Jack; Davis & Jack, LLC

(57) ABSTRACT

A ground augering assembly comprising a dirt dispersing plate having a forward dirt screeding face and having a lower augering depth stopping face; a "C" clamp for alternatively mounting on to and releasing from an auger blade; and a rotation facilitating helically threaded lug, eyed plate, and helically threaded nut combination interconnecting the dirt dispersing plate and the "C" clamp.

9 Claims, 4 Drawing Sheets

GROUND AUGERING ASSEMBLY

FIELD OF THE INVENTION

This invention relates to helical blade ground augers. More particularly, this invention relates to assemblies which attach to or include such augers for improvement of such augers' performance capabilities.

BACKGROUND OF THE INVENTION

A typical or common dirt or earth boring ground auger has a central rotatable drive shaft, and has at least a first helical blade or screw flight attached thereto, such blade extending spirally along the drive shaft. In a particularly useful embodiment, such common earth boring auger presents twin flights of blades, and is rotatably driven as an auxiliary hydraulically powered implement by a skid steer loader or front loader construction vehicle.

A commonly encountered drawback or deficiency of such ground boring augers relates to their tendency, during ground augering, to deposit accumulations of loose earth at the periphery of the upper lip of the augered hole. Upon completion of augering and upon upward extraction of the auger from the hole, such loose earth accumulations tend to undesirably cascade downwardly into the newly augered hole, partially filling the hole.

Augering assemblies such as those disclosed in U.S. Pat. Nos. 2,887,300; 5,067,570; 2,061,218; 2,321,680; 2,709,572; and 4,364,441 (issued respectively to Meredith, Gilcrease, Watson, Houston; Ageborn, and Geeting) attempt to address and solve such dirt cascading and hole filling problem by configuring an auger assembly to present dirt screeding or plowing blades. Such blades are known to be attachable at the upper end of the auger's blades, and upon rotation of the auger, to co-rotate with the auger to disperse accumulated dirt from the lip of the augered hole. A problem associated with such known augering assemblies is that they typically require continuation of augering to a fixed depth matching the vertical span of the auger blades prior to performance of any radial dirt dispersion. Accordingly, such known assemblies undesirably fail to perform any dirt dispersing function when the desired depth of an augered hole is less than the effective vertical length of the auger.

The instant invention solves or ameliorates the problems discussed above by specially configuring an augering assembly to include an alternatively mountable and removable dirt screeding or plowing plate which is capable of dually functioning as a augering depth stop and, upon reaching a selected depth of augering, as a dirt dispersing element.

BRIEF SUMMARY OF THE INVENTION

A first structural component of the instant inventive ground augering assembly comprises a plate having a proximal end, a distal end, a forward dirt plowing or screeding face, and having a lower augering depth stopping face. In a preferred embodiment of the instant invention, such plate comprises durable steel.

A further structural component of the instant inventive ground augering assembly comprises means for alternatively mounting the plate upon an earth augering blade and releasing such plate from such blade. In a preferred embodiment, such mounting and releasing means comprises an auger blade edge receiving "C" clamp which includes a series of set screws for compressively securing such clamp upon the auger blade. Suitably, other commonly known mounting and releasing means such as screw and helically threaded aperture combinations or helically threaded bolt, eye, and nut combinations, may be substituted for the preferred "C" clamp mounting and releasing means.

A further structural component of the instant inventive ground augering assembly comprises attaching means which are adapted for fixedly interconnecting the plate's proximal end and the auger blade mounting and releasing means. Preferably, the attaching means comprises a helically threaded lug, eyed mounting plate, and helically threaded nut combination. Such preferred combination advantageously allows the mounting plate (along with the dirt screeding plate attached thereto) to be, upon loosening of the nut, pivotally moved or rotated to an orientation which vertically aligns the dirt screeding plate. Such preferred attaching means combination also advantageously allows the plate to be oriented and reoriented vertically in the events of interchangeable mountings and re-mountings upon differently pitched auger blades. Other commonly known attaching means such as heat fusion welds, screw and threaded aperture mounts, nut, eye and bolt attachments, and riveted attachments may be suitably, though less desirably, substituted for the preferred helically threaded lug, eyed mounting plate, and helically threaded nut combination.

In use of the instant inventive assembly, and assuming for the sake of example that an 18" diameter earth boring auger having a vertical blade span of 36" is to be utilized to bore an 18" deep hole, and further assuming provision of preferred structures as described above, an operator utilizing the assembly may secure its "C" clamp mounting and releasing means so that the screeding plate's lower auger depth stopping face is situated 18" above the lower end of the auger blade. Thereafter, the "C" clamp's set screws may be tightened to securely compress against and hold the clamp and screeding plate assembly at such location. Thereafter, the threaded lug, eyed mounting plate, and nut combination attaching means may be manipulated to further secure the screeding plate in a substantially vertical orientation.

Upon assembly and orientation of structures as described above, the inventive auger assembly may be utilized for vertical earth boring in a conventional fashion, causing the attached screeding plate to move orbitally about the auger's axial drive shaft. In the event, for example, that accumulations of loose dirt deposited by the auger at the lip of augered hole reach a height of 6" over the ground surface at the time the depth of augering reaches 12", radial plowing dispersion of dirt by the orbiting screeding plate commences at that time. Such radial dispersion of dirt continues during the final 6" of augering, at the end of which (i.e., at the 18" depth) the screeding plate's lower augering depth stopping face contacts the horizontal ground surface at the periphery of the augered hole. Upon such contact, the vertical progress of the augering is advantageously stopped at the selected 18" depth, and the lower edge of such orbiting plate advantageously radially screeds and disperses dirt accumulations away from the edge of the hole. Such radial screeding advantageously creates a circular and peripheral buffer zone at the lip of the hole, such zone being substantially cleared of loose dirt. Thereafter, the auger may be raised from the hole without any undesirable cascading of soil back into the hole. Instead of re-filling the augered hole, any cascading dirt desirably falls onto and deposits at and within the peripheral buffer zone without falling into the hole.

Accordingly, it is an object of the instant invention to provide an augering assembly which incorporates components and structures, as described above, and which arranges those components and structures in the manner described above for the performance of advantageous and beneficial functions as described above. Other and further objects, benefits, and advantages of the instant invention will become known to those skilled in the art upon review of Detailed Description which follows, and upon review of the appended drawings.

DETAILED DESCRIPTION OF A PREFERRED EMBODIMENT

Figure 1:
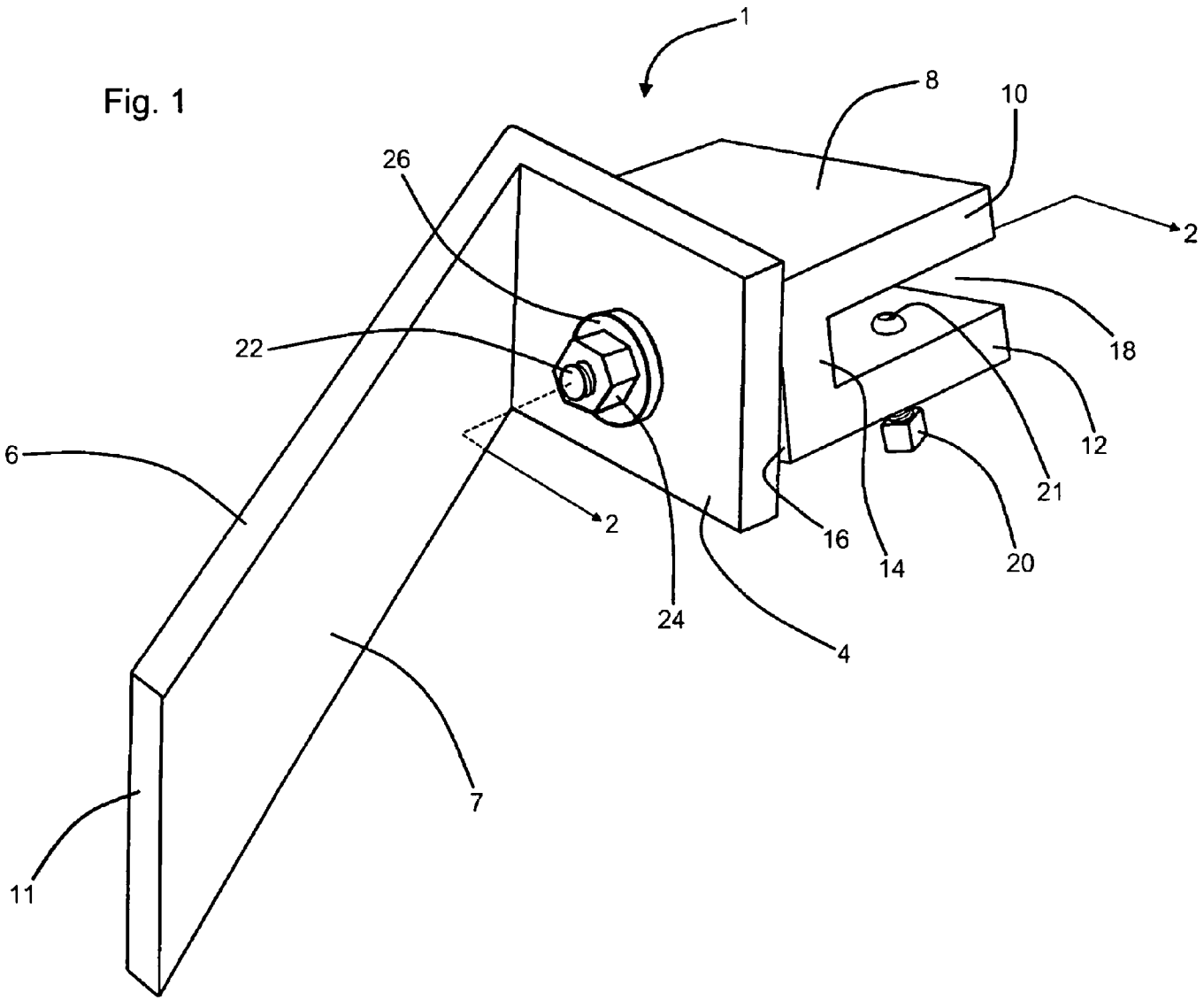
FIG. 1 is a perspective view of a preferred embodiment of the instant inventive ground augering assembly.

Referring now to the drawings, and in particular to Drawing FIG. 1, a preferred embodiment of the instant inventive ground augering assembly is referred to generally by Reference Arrow 1. The assembly 1 preferably comprises a dirt screeding or plowing plate 6. Such plate 6 is preferably composed of durable steel and has, referring further simultaneously to FIG. 3, a rear face 7, a forwardly oriented and rearwardly angled dirt screeding or plowing face opposite the rear face, a distal end 11, a proximal end opposite the distal end, and a lower augering depth stopping face 9.

Figure 2:
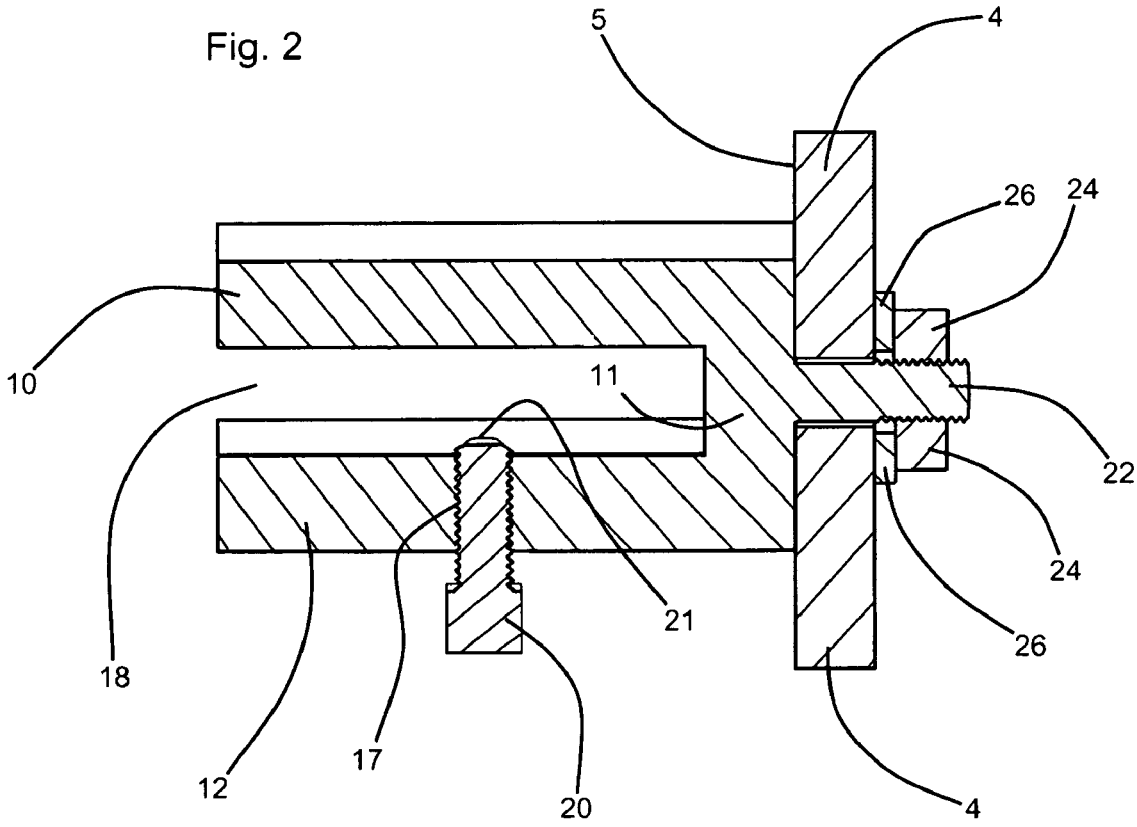
FIG. 2 is a sectional view as indicated in FIG. 1.
Figure 3:
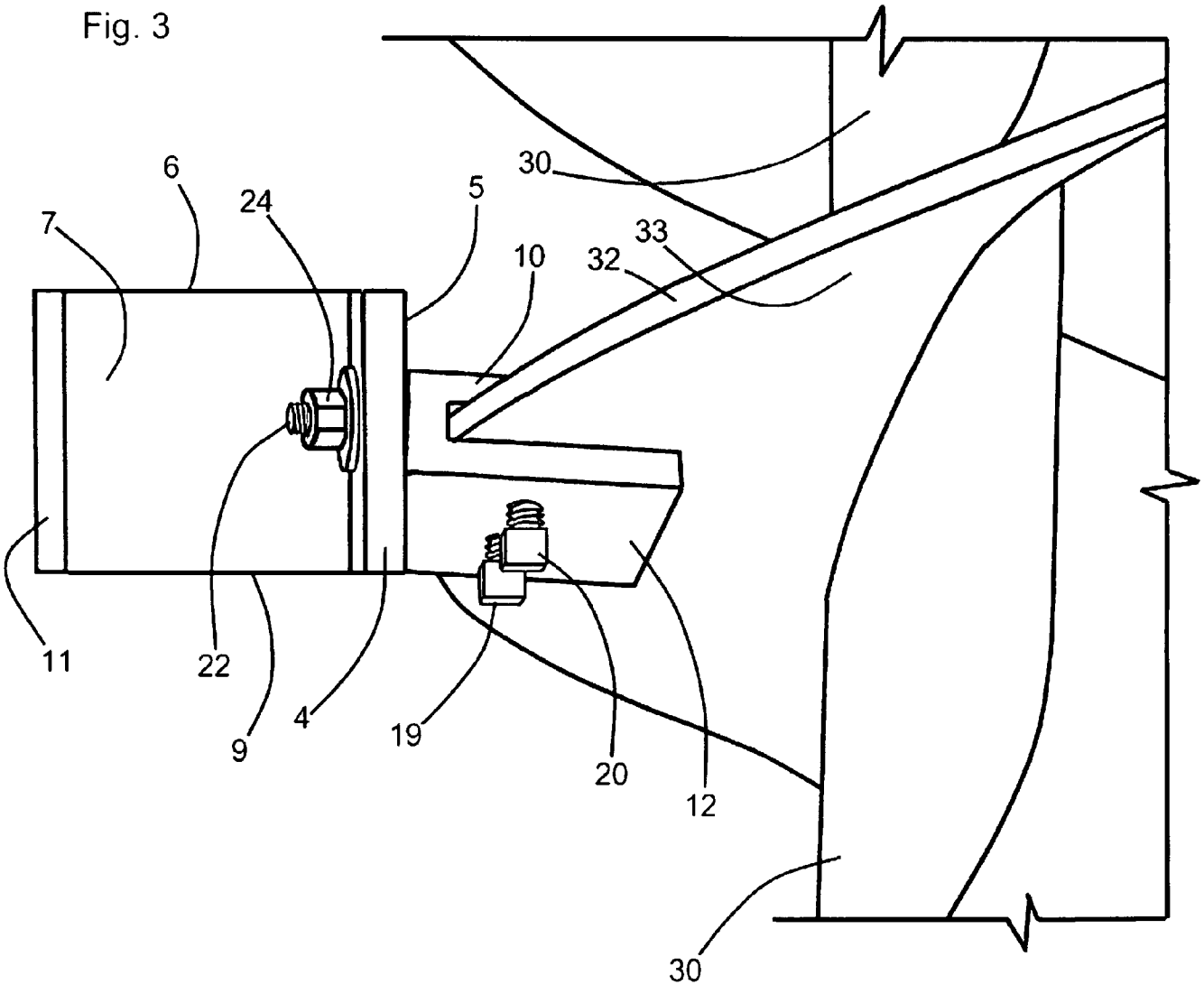
FIG. 3 presents a rear view of the instant inventive assembly, the assembly further comprising an earth boring auger.

Referring simultaneously to FIGS. 1-3, mounting and releasing means are provided, such means preferably comprising a "C" clamp which includes a base section 13, an upper arm 10, and a lower arm 12. Such "C" clamp preferably forms and defines an auger blade edge receiving space 18, and preferably comprises at least a first, and preferably a series of helically threaded apertures 17, each such aperture extending through the "C" clamp's lower arm 12. Such apertures 17 receive helically threaded set screws 19 and 20. Upon threaded downward retraction of the set screws 19 and 20, the auger blade edge receiving space 18 is mechanically cleared for radial receipt of an edge 32 of an auger blade 33. Upon such receipt as depicted in FIG. 3, the set screws 19 and 20 may be tightened, causing their upper ends 21 to move upwardly to impinge and compress against the lower surface of the auger blade 33, securing the "C" clamp upon such blade.

The "C" clamp mounting and releasing means described above and depicted in FIGS. 1-3 is intended to be representative of other suitably used and substituted mounting and releasing means such as common screw and threaded aperture attachments [not depicted] or common bolt, eye, and threaded nut attachments [also not depicted].

Referring further to Drawing FIGS. 1-3, attaching means are also provided, such means preferably comprising a combination of a mounting plate 4, a helically threaded lug 22 fixedly attached to and extending radially outwardly from the base 13 of the "C" clamp, a helically threaded nut 24, and a washer 26. Upon tightening of the nut 22 over the threaded lug 22, the radially inner face of the nut 22 drives against the washer 26 and against the mounting plate 4, compressing the radially interface 5 of the mounting plate 4 against the radially outer face of the base section 13 of the "C" clamp, such mechanical compression advantageously holding the screeding plate 6 at a desirable vertical orientation with respect to a particularly pitched auger blade 33. Such preferred attaching means advantageously interconnects the proximal end of the plate 6 and the "C" clamp mounting and releasing means in a manner allowing such clamp to be fixed in a first angular orientation by tightening of nut 24, and allowing such "C" clamp to be subsequently pivoted and rotated to a second angular orientation via loosening and re-tightening of the nut 24. Such preferred attaching means advantageously dually functions as a secure mechanical interconnection between the plate 6 and the "C" clamp and as means for adjusting and re-adjusting the angular orientation of the plate in order to assure that the screeding and plowing face of the blade remains substantially vertically oriented while in use. Accordingly, the blade, "C" clamp, and attaching means assembly may be used upon various augers having differently pitched blades while assuring that the plate 6 remains vertical while in use.

Figure 4:
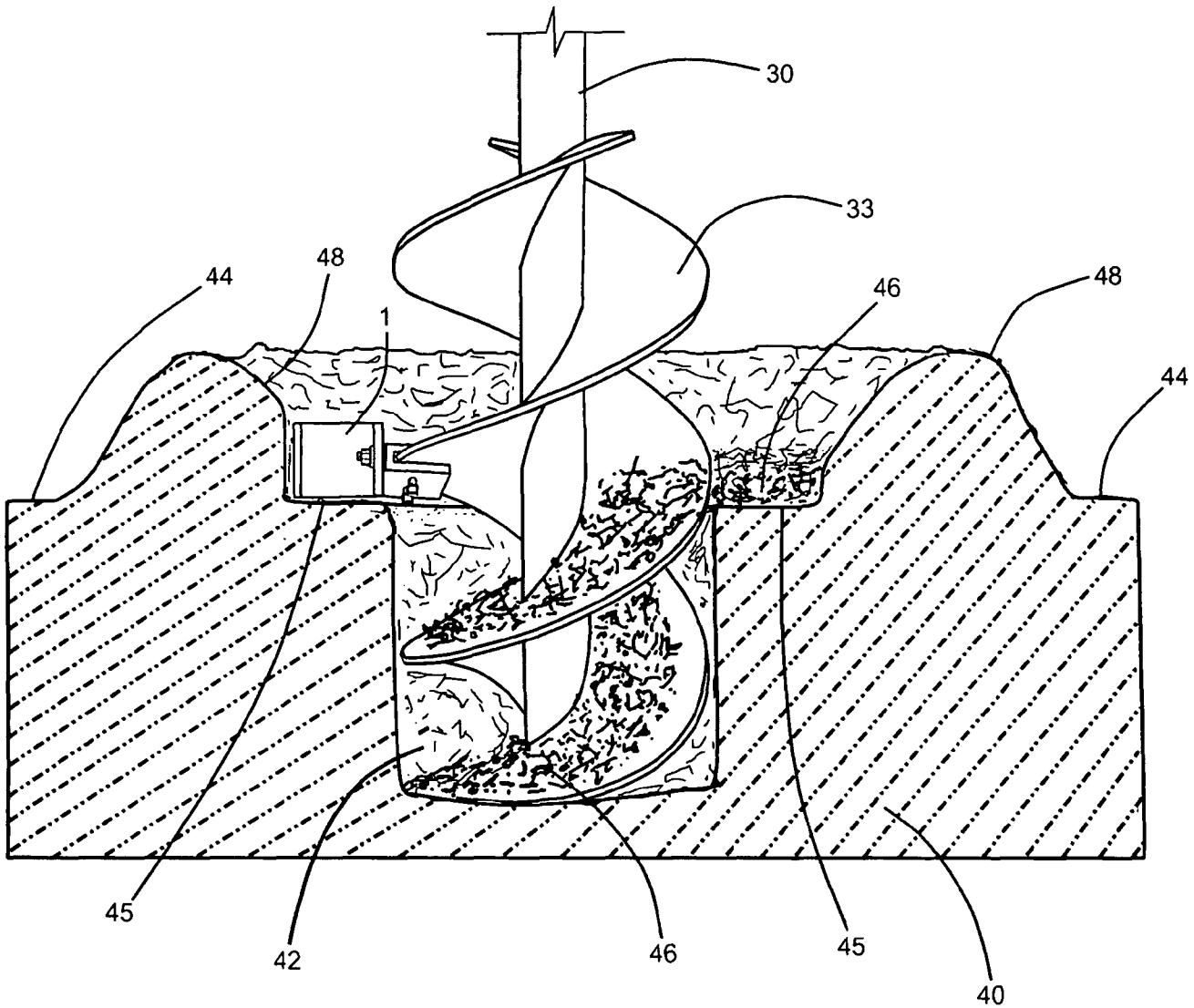
FIG. 4 shows the instant inventive assembly in use.

In use of the instant inventive augering assembly, referring in particular to Drawing FIG. 4, upon augering of a hole 42 by the auger shaft 30 and blade 33 assembly within the earth 40, loose dirt 46 tends to be conveyed upwardly and to be peripherally deposited as a circular mound 48 upon the ground surface 44 at the periphery of the upper lip of the augered hole 42.

Referring simultaneously to Drawing FIGS. 3 and 4, as such augering progresses, as the forward face of the screeding plate 6 orbits about shaft 30, such face contacts the upwardly conveyed and accumulated dirt 46, and such face radially outwardly disperses such dirt from the upper lip of the augered hole 42. Eventually, upon continued downward augering, the lower augering depth stopping face 9 of the screeding plate 6 reaches the ground level 44. At that point, vertical downward progression of augering is advantageously stopped at the depth which is represented by the selected installation location of the assembly 1. Also, at such point, continued orbital movement of the screeding plate 6 at the ground level tends to create a screeded and cleared peripheral buffer zone 45.

Referring further simultaneously to FIGS. 3 and 4, upon completion of augering, the auger shaft 30 and blade 33 assembly may be raised from the augered hole 42. Thereafter, loose dirt which may cascase downwardly from the peripheral inner surface of mound 48 advantageously falls onto and deposits at the peripheral buffer zone 45 without further falling into and re-filling the augered hole 42.

While the principles of the invention have been made clear in the above illustrative embodiment, those skilled in the art may make modifications in the structure, arrangement, portions and components of the invention without departing from those principles. Accordingly, it is intended that the description and drawings be interpreted as illustrative and not in the limiting sense, and that the invention be given a scope commensurate with the appended claims.

I claim:

1. A ground augering assembly comprising:

(a) a dirt dispersing plate having a forward dirt screeding face and having a lower augering depth stopping face;

(b) means for alternatively mounting upon and releasing from an auger blade;

(c) attaching means fixedly interconnecting the dirt dispersing plate and the auger blade mounting and releasing means.

2. The ground augering assembly of claim 1 wherein the auger blade mounting and releasing means comprises a "C" clamp having a blade edge receiving space.

3. The ground augering assembly of claim 2 wherein the "C" clamp comprises upper and lower arms.

4. The ground augering assembly of claim 3 wherein the "C" clamp further comprises at least a first set screw connected operatively to one of the "C" clamp's arms.

5. The ground augering assembly of claim 4 further comprising a dirt auger having a helical blade, the helical blade having an outer edge extending into the "C" clamp's blade edge receiving space.

6. The ground augering assembly of claim 1 wherein the attaching means comprises a mounting plate.

7. The ground augering assembly of claim 6 wherein the attaching means further comprises a pivot mount operatively interconnecting the mounting plate and the auger blade mounting and releasing means, the pivot mount being adapted for alternatively fixing the mounting plate in a first angular orientation, and releasing the mounting plate for pivoting movement to, and for refixing at a second angular orientation.

8. The ground augering assembly of claim 7 wherein the pivot mount comprises a helically threaded lug, eyed plate, and helically threaded nut combination.

9. The ground augering assembly of claim 8 further comprising a dirt auger having a helical blade, the helical blade having an outer edge received by the auger blade mounting and releasing means.

* * * * *